US006341435B1

(12) United States Patent
Erickson

(10) Patent No.: US 6,341,435 B1
(45) Date of Patent: Jan. 29, 2002

(54) DITCH DIGGING AND CLEANING SYSTEM HAVING DUAL DISPERSING MEMBERS

(76) Inventor: Edwin A. Erickson, 13946--86th St. SE., Milnor, ND (US) 58060-9750

( * ) Notice: Subject to any disclaimer, the term of this patent is extended or adjusted under 35 U.S.C. 154(b) by 0 days.

(21) Appl. No.: 09/638,323

(22) Filed: Aug. 14, 2000

Related U.S. Application Data

(63) Continuation of application No. 09/315,743, filed on May 20, 1999, now Pat. No. 6,226,903.

(51) Int. Cl.[7] ..... E02D 17/13; E02F 5/10

(52) U.S. Cl. ..... 37/366; 172/149

(58) Field of Search ..... 37/366, 367, 380, 37/381; 172/784, 817, 823, 149

(56) References Cited

U.S. PATENT DOCUMENTS

| | | | | | |
|---|---|---|---|---|---|
| 16,007 | A | * | 11/1856 | Evans | 172/542 |
| 709,601 | A | * | 9/1902 | Horner | 172/149 |
| 1,095,097 | A | * | 4/1914 | Fournet | 37/92 |
| 1,175,926 | A | * | 3/1916 | Bunnell | 37/354 |
| 1,320,285 | A | * | 10/1919 | Smith | 172/149 |
| 2,027,502 | A | * | 1/1936 | Weismüller | 111/200 |
| 2,453,723 | A | * | 11/1948 | Palmer et al. | 37/366 |
| 2,662,311 | A | * | 12/1953 | Chattin | 37/372 |
| 2,788,726 | A | * | 4/1957 | Keyes | 172/73 |
| 2,885,800 | A | * | 5/1959 | Hawkins | 37/91 |
| 2,923,073 | A | * | 2/1960 | Baker et al. | 37/92 |
| 2,965,985 | A | * | 12/1960 | Sillasen et al. | 37/92 |
| 2,990,632 | A | * | 7/1961 | Noblin | 37/366 |
| 3,025,618 | A | * | 3/1962 | Croucher | 37/354 |
| 3,624,826 | A | * | 11/1971 | Rogers | 37/92 |
| 4,161,072 | A | * | 7/1979 | Pronovost | 37/93 |
| 4,976,052 | A | * | 12/1990 | Jeane | 37/109 |
| 5,027,534 | A | * | 7/1991 | Sackett | 37/91 |
| 5,113,610 | A | * | 5/1992 | Liebrecht, Jr. | 37/94 |
| 5,237,761 | A | * | 8/1993 | Nadeau et al. | 37/92 |
| 5,255,454 | A | * | 10/1993 | Pounds | 37/94 |

* cited by examiner

*Primary Examiner*—Robert E. Pezzuto
*Assistant Examiner*—Arpad Fabian Kovacs
(74) *Attorney, Agent, or Firm*—Michael S. Neustel

(57) ABSTRACT

A ditch digging and cleaning device includes a frame having a hitch and a pair of support arms with wheels, a pair of front blades, a pair of side blades, a pair of dispersing members rotatably attached to the frame, a drive system mechanically connected to the dispersing members, and a pair of deflector structures attached to the rear portion of the frame. The dispersing members are each comprised of a circular base, and a plurality of fan blades orthogonally attached to an upper surface of the circular base. The dispersing members are juxtaposed behind pans attached to the front blades. The dispersing members are also less than 45 degrees with respect to the ground surface. The blades preferably are V-shaped for penetrating hardened soil. Coulters may be added in front of the front blade for loosening the ground or a beater member. In operation, the front blades sever the dirt from the ground surface at a desired depth. The dirt is passed over the pans onto the dispersing members where after the fan blades throw the dirt toward the deflector structures that guide the dirt in the desired location.

17 Claims, 6 Drawing Sheets

DITCH DIGGING AND CLEANING SYSTEM HAVING DUAL DISPERSING MEMBERS

CROSS-REFERENCE TO A RELATED PATENT APPLICATION

This is a continuation-in-part application for U.S. patent application Ser. No. 09/315,743 filed on May 20, 1999, now U.S. Pat. No. 6,226,903, issued May 8, 2000.

BACKGROUND OF THE INVENTION

1. Field of the Invention

The present invention relates generally to ditch diggers and more specifically it relates to a ditch digging and cleaning system having dual dispersing members for easily digging ditches, cleaning ditches, and creating terraces with reduced power take-off (PTO) power.

Farmers often times desire to dig ditches for draining water from fields thereby increasing the usability of the land. In addition, farmers often times desire to construct terraces on uneven land. Hence, it is desirable to have a single machine that both digs ditches and creates terraces.

2. Description of the Prior Art

Ditch digging devices have been in use for years. Typically, a rotary blade member is utilized that has a rotational plane parallel to a vertical axis. The lower edge of a rotary blade engages, cuts and throws the dirt creating a curved ditch structure.

Conventional ditch diggers require significant PTO power to the PTO shaft since the rotary blade is initially engaging, cutting and throwing the dirt. In addition, conventional ditch diggers merely cutout a curved ditch that easily fills in with dirt and debris over time requiring constant cleaning. Also, a curved ditch is incapable of handling as large of volume of water as a flat bottomed ditch of the same width. In additional, the velocity of water flowing through a conventional curved ditch is significantly higher than a flat bottomed ditch of the same width thereby increasing erosion of the land.

Examples of ditch diggers include U.S. Pat. No. 5,113,610 to Liebrecht, Jr.; U.S. Pat. No. 2,965,985 to Sillasen; U.S. Pat. No. 5,237,761 to Nadeau; U.S. Pat. No. 3,624,826 to Rogers; U.S. Pat. No. 3,025,618 to Croucher; U.S. Pat. No. 2,923,073 to Baker; U.S. Pat. No. 2,885,800 to Hawkins; U.S. Pat. No. 1,175,926 to Bunnell; U.S. Pat. No. 1,095,097 to Fournet; U.S. Pat. No. 5,027,534 to Sackett; U.S. Pat. No. 16,007 to Evans which are all illustrative of such prior art.

Liebrecht, Jr. (U.S. Pat. No. 5,113,610) discloses a rotating disk type ditcher. Liebrecht teaches a frame structure, a PTO power system, and a cutting disk inclined downwardly so that the leading edge cuts into the ground. A plurality of paddles or scoops are positioned on the back side of the disk that throw the soil particles.

Sillasen (U.S. Pat. No. 2,965,985) discloses a rotary whirling ditcher. Sillasen teaches a frame, a drive assembly, and a plurality of rotating blades.

Nadeau (U.S. Pat. No. 5,237,761) discloses a rotary ditcher having ripper blades. Nadeau teaches a flywheel type rotor carrying impeller blades that pickup and throw soil to the side of the rotor, and two ripper blades in front of the rotor that loosen the soil.

While these devices may be suitable for the particular purpose to which they address, they are not as suitable for easily digging ditches, cleaning ditches, and creating terraces with reduced power take-off (PTO) power. Conventional machines require extensive PTO power for operating properly which can be extremely demanding upon a tractor vehicle.

In these respects, the ditch digging and cleaning system according to the present invention substantially departs from the conventional concepts and designs of the prior art, and in so doing provides an apparatus primarily developed for the purpose of easily digging ditches, cleaning ditches, and creating terraces with reduced power take-off (PTO) power.

SUMMARY OF THE INVENTION

In view of the foregoing disadvantages inherent in the known types of ditch diggers now present in the prior art, the present invention provides a new ditch digging and cleaning system construction wherein the same can be utilized for easily digging ditches, cleaning ditches, and creating terraces with reduced power take-off (PTO) power.

The general purpose of the present invention, which will be described subsequently in greater detail, is to provide a new ditch digging and cleaning system that has many of the advantages of the ditch diggers mentioned heretofore and many novel features that result in a new ditch digging and cleaning system which is not anticipated, rendered obvious, suggested, or even implied by any of the prior art ditch diggers, either alone or in any combination thereof.

To attain this, the present invention generally comprises a frame having a hitch and a pair of support arms with wheels, a pair of front blades, a pair of side blades, a pair of dispersing members rotatably attached to the frame, a drive system mechanically connected to the dispersing members, and a pair of deflector structures attached to the rear portion of the frame. The dispersing members are each comprised of a circular base, and a plurality of fan blades orthogonally attached to an upper surface of the circular base. The dispersing members are juxtaposed behind pans attached to the front blades. The dispersing members are also less than 45 degrees with respect to the ground surface. The blades preferably are V-shaped for penetrating hardened soil. Coulters may be added in front of the front blade for loosening the ground or a beater member. In operation, the front blades sever the dirt from the ground surface at a desired depth. The dirt is passed over the pans onto the dispersing members where after the fan blades throw the dirt toward the deflector structures that guide the dirt in the desired location.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a ditch digging and cleaning system that will overcome the shortcomings of the prior art devices.

Another object is to provide a ditch digging and cleaning system that requires significantly less PTO power than conventional ditch digging devices.

Another object is to provide a ditch digging and cleaning system that utilizes dual dispersing members to remove soil and debris.

An additional object is to provide a ditch digging and cleaning system that can be utilized to dig ditches, clean ditches or create terraces within a field.

A further object is to provide a ditch digging and cleaning system that creates a flat bottomed ditch thereby reducing the velocity of water flow.

Another object is to provide a ditch digging and cleaning system that can be connected to most tractors.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
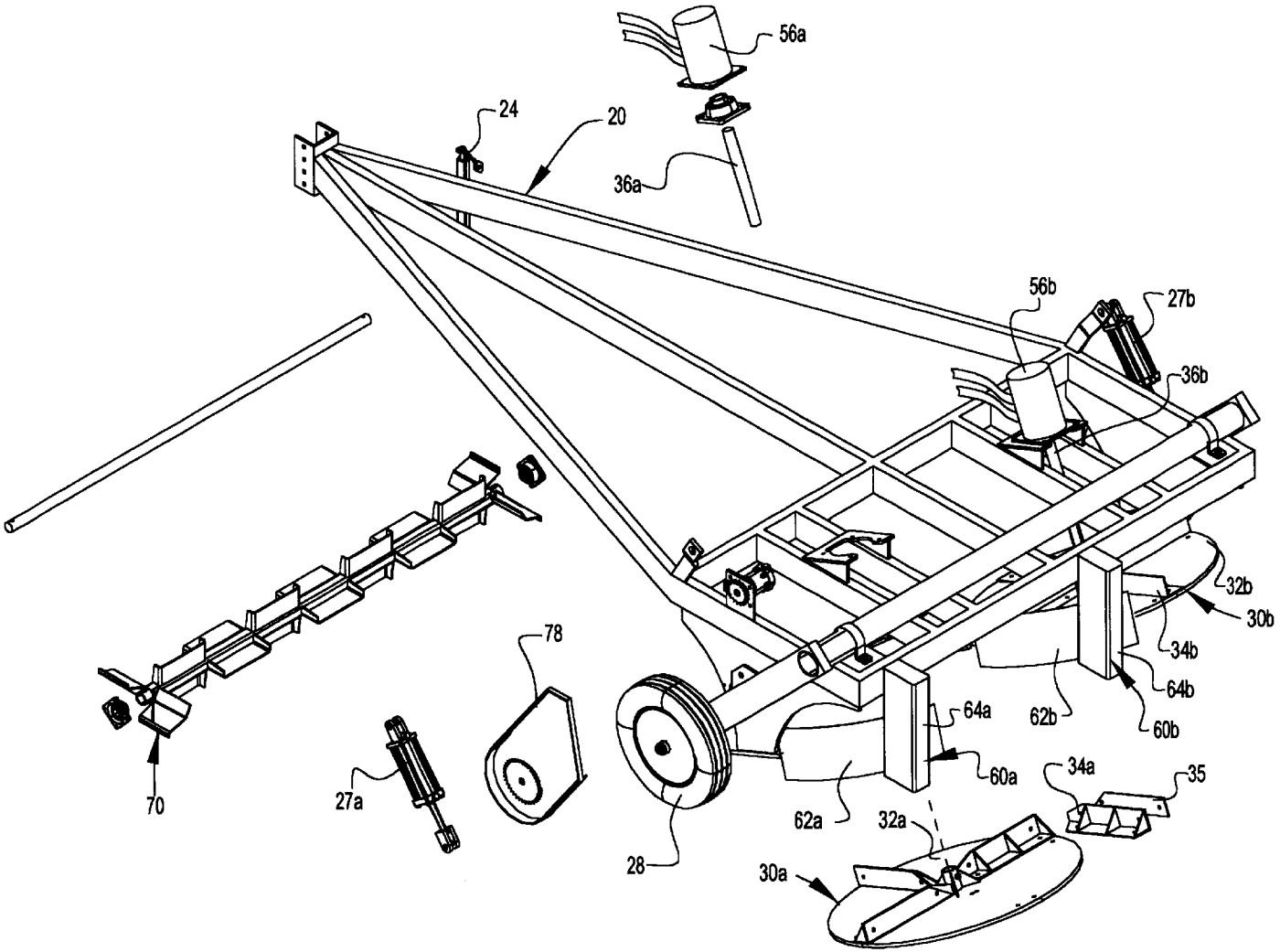
FIG. 1 is an exploded upper perspective view of the present invention.

Turning now descriptively to the drawings, in which similar reference characters denote similar elements throughout the several view, FIGS. 1 through 4 illustrate a ditch digging and cleaning system 10, which comprises a frame 20 having a hitch 22 and a pair of support arms 26*a–b* with wheels 28, a pair of front blades 40*a–b*, a pair of side blades 42, a pair of dispersing members 30*a–b* rotatably attached to the frame 20, a power train mechanically connected to the dispersing members 30*a–b*, and a pair of deflector structures 60*a–b* attached to the rear portion of the frame 20. The dispersing members 30*a–b* are each comprised of a circular base 32*a–b*, and a plurality of fan blades 34*a–b* orthogonally attached to an upper surface of the circular base 32. The dispersing members 30*a–b* are juxtaposed behind pans 44*a–b* attached to the front blades 40*a–b*. The dispersing members 30*a–b* are also less than 45 degrees with respect to the ground surface. The blades 40*a–b* are preferably V-shaped for penetrating hardened soil. Coulters may be added in front of the front blades 40*a–b* for loosening the ground. In addition, a beater member 70 may be utilized to breakup and feed the soil 14 into the dispersing members 30*a–b*.

Figure 2:
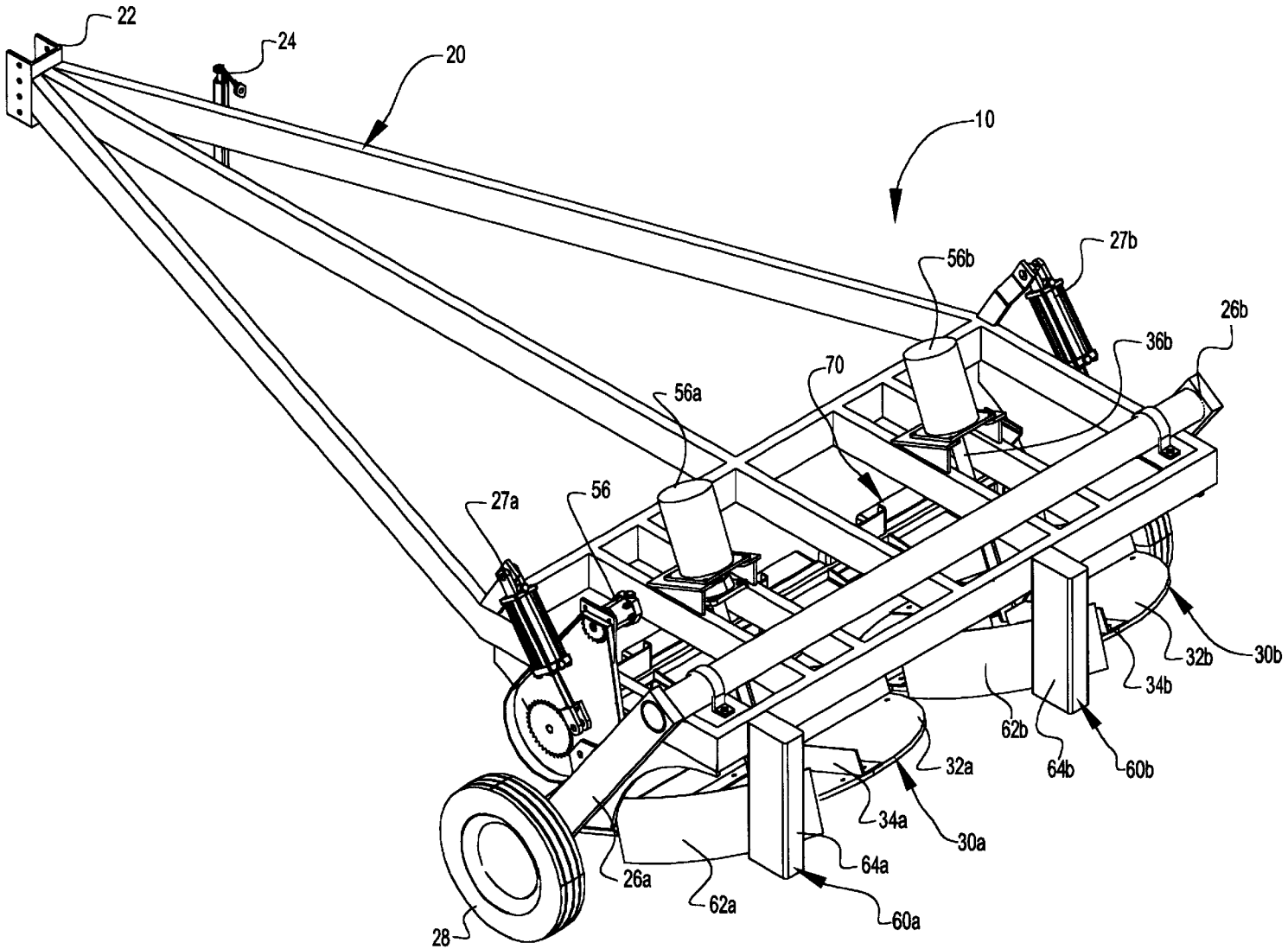
FIG. 2 is an upper perspective view of the present invention.
Figure 4:
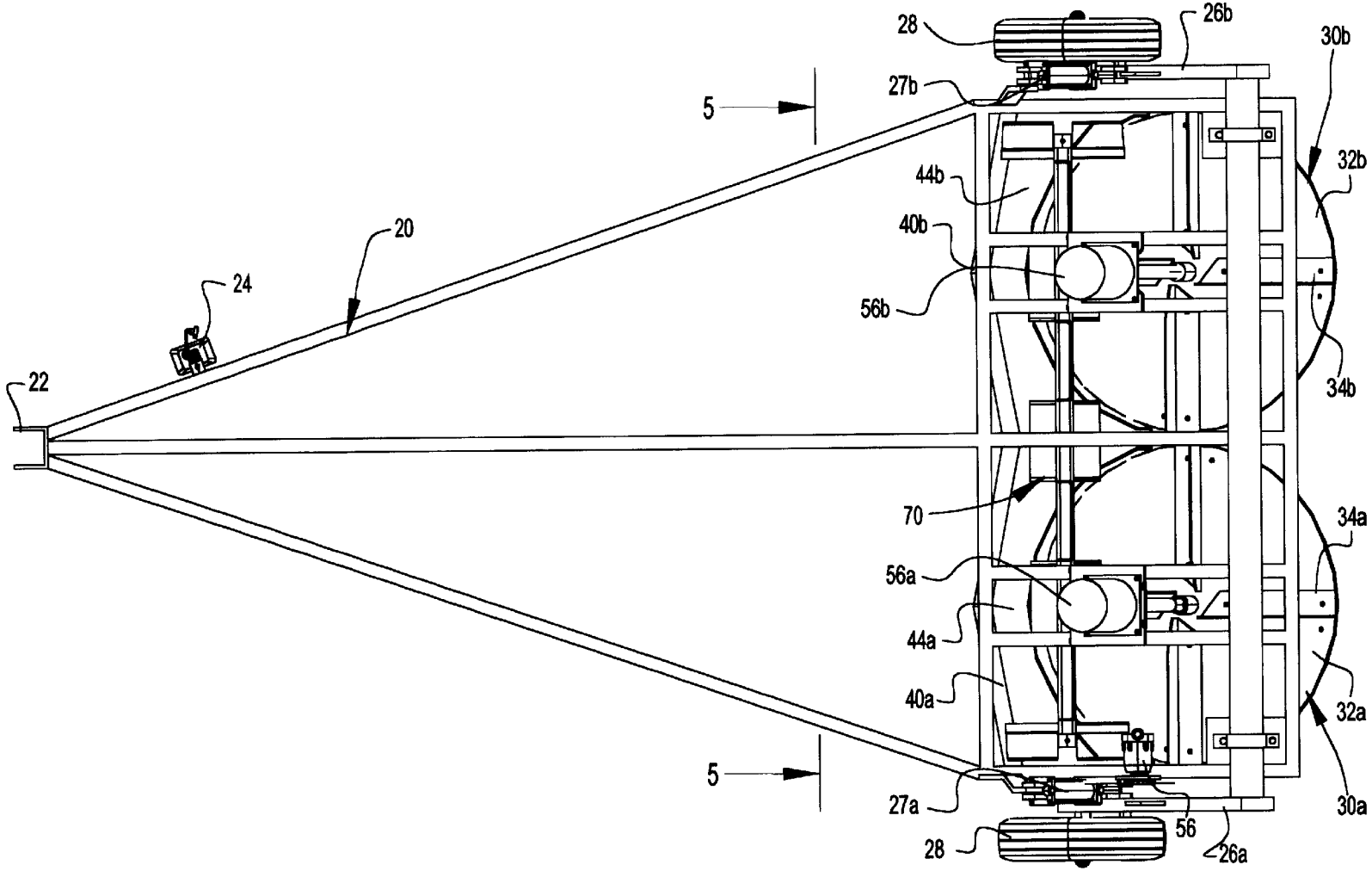
FIG. 4 is a top view of the present invention.

As best shown in FIGS. 1, 2 and 4 of the drawings, the frame 20 includes a hitch 22 for connecting to a tractor vehicle. A jack 24 is attached to the front portion of the hitch 22 for supporting the hitch 22 when not attached to a tractor.

Figure 3:
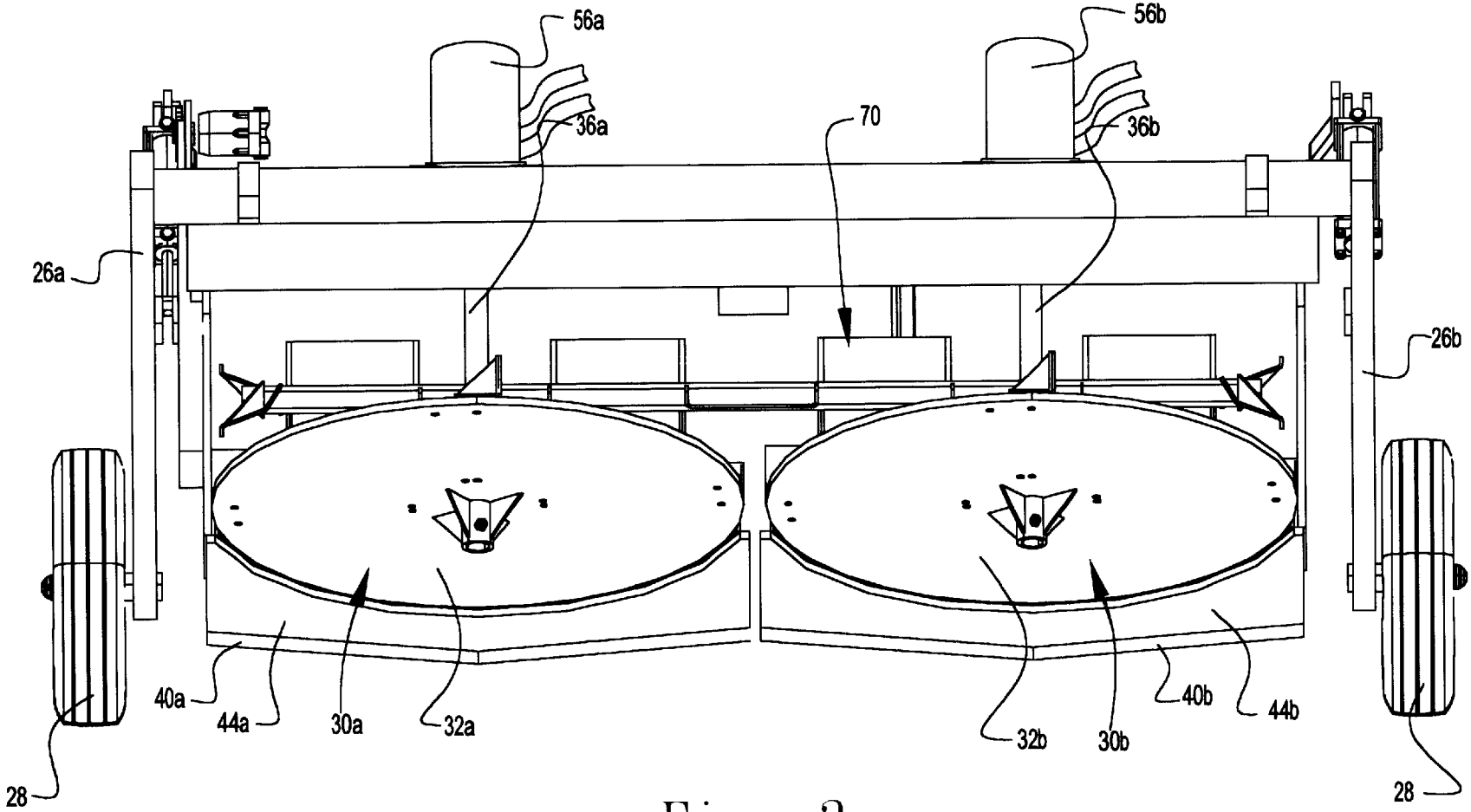
FIG. 3 is a rear view of the present invention showing the dual dispersing members.

A pair of support arms 26*a–b* are pivotally attached to the rear portion of the frame 20 as shown in FIGS. 1 and 3 of the drawings. The support arms 26*a–b* are preferably angled forwardly as best shown in FIG. 3 of the drawings. A pair of wheels 28 are rotatably attached to the distal ends of the support arms 26*a–b* as shown in FIGS. 1, 3 and 4 of the drawings. A pair of hydraulic cylinders 27*a–b* are connected between the frame 20 and the support arms 26*a–b* for elevating and lowering the frame 20 as best shown in FIG. 3 of the drawings. The hydraulic cylinders 27*a–b* control the depth of the front blades 40*a–b*. As best shown in FIG. 4 of the drawings, the wheels 28 are positioned outside of the front blades 40*a–b* thereby ensuring an even cut through the ground surface.

Figure 5:
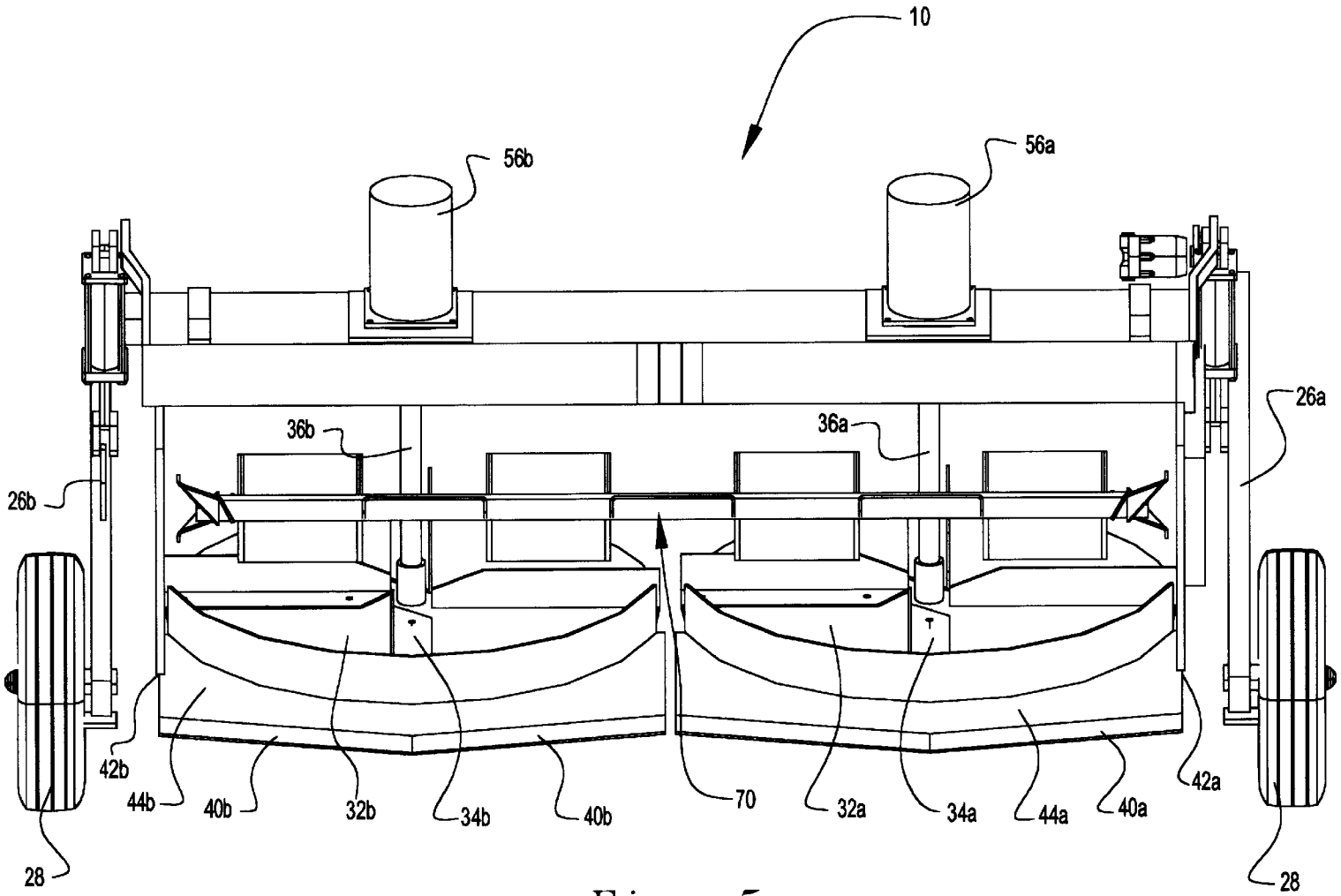
FIG. 5 is a front view of the present invention showing the dual dispersing members behind the dual front blades.

As best shown in FIG. 2 of the drawings, the front blades 40*a–b* is attached to the frame 20 along with a pair of side blades 42. Each of the front blades 40*a–b* preferably has a V-shape for providing easy penetration into a hardened ground as best shown in FIGS. 3 and 5 of the drawings. The front blades 40*a–b* are preferably removable and replaceable after periods of extended use. The pair of side blades 42 are substantially vertically orientated along the sides of the front blades 40*a–b* as shown in FIG. 2 of the drawings. A pair of pans 44*a–b* are attached behind the front blades 40*a–b* for channeling the newly cut dirt rearwardly into the dispersing members 30*a–b*. The pans 44*a–b* have a semi-circular cutout that receives the dispersing members 30*a–b* as best shown in FIG. 1 of the drawings.

A power train is attached to the frame 20 such as a PTO driven system or hydraulic driven system. The power train may comprise a PTO shaft, a gear box, and a drive shaft. The PTO shaft is rotatably attached to the frame 20 and is connectable at one end to the PTO of a conventional tractor. The gear box is attached to the opposing end of the PTO shaft for converting the rotational speed downward. The drive shaft is connected to the gear box and to the dispersing members 30*a–b*. Alternatively, a pair of hydraulic motors may be mechanically connected to the dispersing members 30*a–b* to rotate the dispersing members 30*a–b*.

As best shown in FIGS. 3 and 4 of the drawings, each of the dispersing members 30*a–b* are generally circular in shape and are rotatably attached to the frame 20 by drive shafts 36*a–b*. The dispersing members 30*a–b* each comprise a flat base 32*a–b* and a plurality of fan blades 34*a–b* attached to an upper surface of the base 32*a–b*. Each of the fan blades 34*a–b* may receive a corresponding wear plate 35 as shown in FIG. 1 of the drawings.

The base 32*a–b* of each of the dispersing members 30*a–b* is circular and has an edge juxtaposed to the semi-circular cutout within the pans 44*a–b*. The base 32*a–b* of each of the dispersing members 30*a–b* is lower than the upper surface of the pans 44*a–b* thereby allowing the dirt to drop onto the base 32*a–b* during usage. Each base 32*a–b* is preferably less than 45 degrees with respect to the ground surface when in operation thereby utilizing reduced PTO power or hydraulic power to elevate the dirt.

Each of the fan blades 34*a–b* are preferably attached substantially orthogonally to the upper surface of the base 32*a–b*. There are preferably four fan blades 34*a–b* upon each of the dispersing members 30*a–b*, however it can be appreciated by one skilled in the art than more or less fan blades 34*a–b* may be utilized. Some of the fan blades 34*a–b* are taller than the other fan blades 34*a–b* for providing increased engagement and throwing of the dirt dropped onto the base 32*a–b* of each of the dispersing members 30*a–b*.

Figure 6:
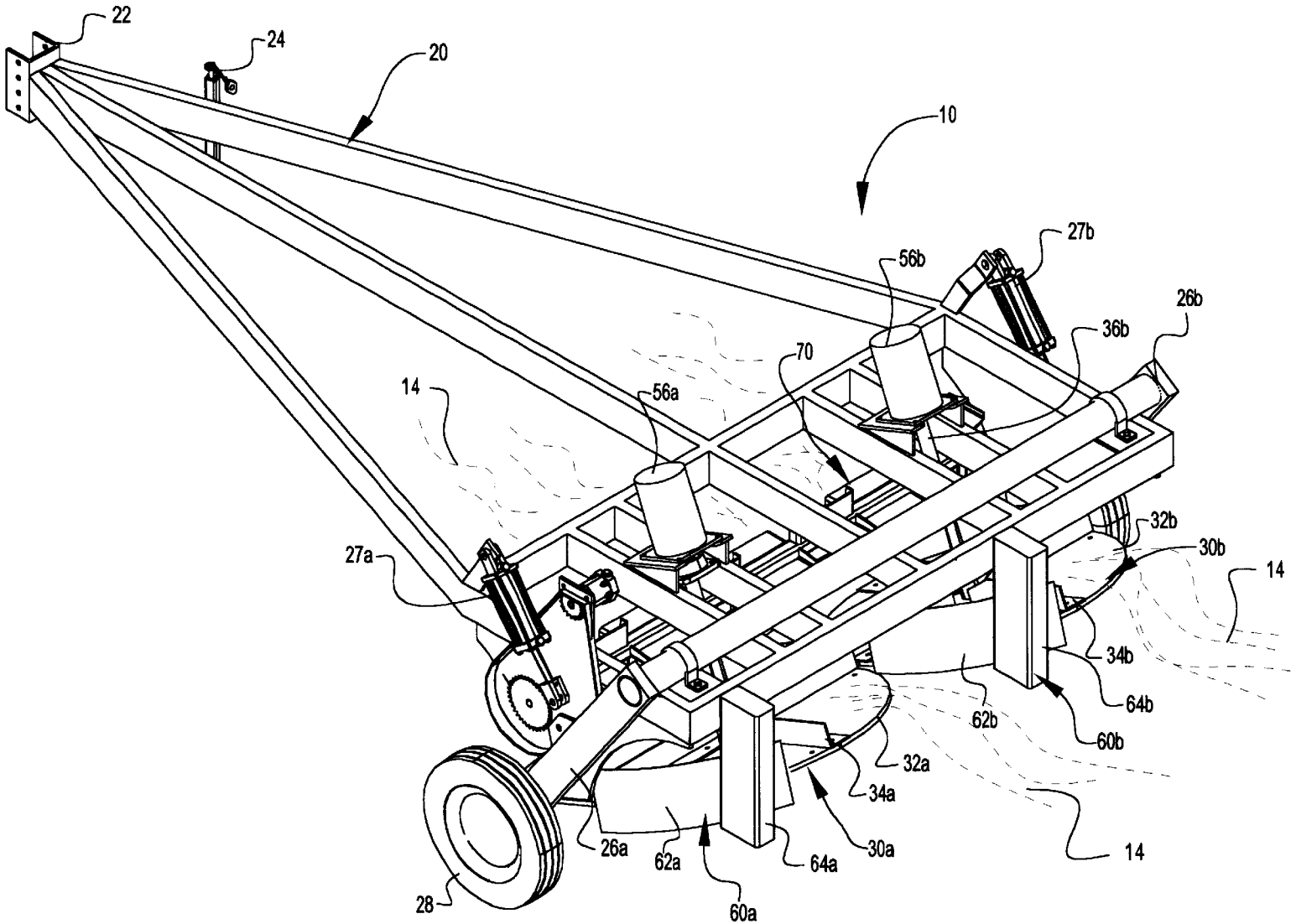
FIG. 6 is an upper perspective view of the present invention showing the dual dispersing members throwing soil material.

As shown in FIGS. 1, 2 and 6 of the drawings, the deflector structures 60*a–b* are attached to the rear portion of the frame 20 for directing the thrown dirt from the dispersing members 30*a–b*. The deflector structures 60*a–b* are each comprised of adjustable brackets 64*a–b*. A pair of deflector members 62*a–b* are attached to the adjustable brackets 64*a–b* for guiding the soil 14 being thrown from the dispersing members 30*a–b* as best shown in FIG. 6 of the drawings.

As best shown in FIG. 5 of the drawings, a beater member 70 is rotatably attached to the frame 20 above the front blades 40*a–b*. A drive motor is attached to the frame 20 and is mechanically connected to the beater member 70 for rotating the beater member 70. The drive motor may be comprised of a conventional electric or hydraulic motor as can be appreciated by one skilled in the art. The beater member 70 is comprised of a plurality of paddles that are utilized to break apart and urge the newly cut soil 14 downwardly onto the dispersing members 30*a–b* as the dirt leaves the pans 44*a–b*.

In use, the user adjusts the hydraulic cylinders 27*a–b* depending upon the depth desired to cut into the ground surface. The user then engages the PTO or hydraulic drive system thereby causing the dispersing members 30*a–b* to rotate in the same rotational direction behind the front blades 40*a–b*. The user then operates the conventional tractor pulling the invention forwardly so that the front blades 40*a–b* penetrate the ground surface. The newly cut dirt flows upon the pans 44*a–b* toward the dispersing members 30*a–b* where the beater member 70 engages the dirt pushing it into the dispersing members 30*a–b*. The dirt falls onto the base 32*a–b* of each dispersing member 30*a–b* where after the fan blades 34*a–b* engage the dirt. The fan blades 34*a–b* throw the dirt outwardly to the side and rearwardly where the deflector structures 60*a–b* deflect a portion of the thrown dirt 14 into the desired direction as best shown in FIG. 6 of the drawings. The soil 14 from the adjacent dispersing members 30*a–b* is thrown at an angle with respect to the frame 20 without the path of the thrown soil 14 engaging the adjacent dispersing member 30*a–b* or the frame as clearly illustrated within FIG. 6 of the drawings. The user may pass over the newly created channel if they desire to dig a deeper channel. If the user desires to create a terrace, the user simply continues passing over the field throwing the dirt in the desired location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ditch digging and cleaning system, comprising:

a frame;

a power train attached to said frame;

at least one front blade attached to said frame, wherein said at least one blade has an angle with respect to a ground surface of less than 45 degrees for severing and upwardly lifting a portion of ground;

a pair of dispersing members rotatably attached to said frame for dispersing said portion of ground elevated by said front blade, wherein each of said dispersing members have a rotational plane less than 45 degrees with respect to said ground surface; and a means for rotating said pair of dispersing members.

2. The ditch digging and cleaning system of claim 1, wherein each of said pair of dispersing members comprises:

a base; and a plurality of blades attached to an upper surface of said base.

3. The ditch digging and cleaning system of claim 2, wherein said base is less than 45 degrees with respect to said ground surface.

4. The ditch digging and cleaning system of claim 2, wherein said base is a flat circular structure.

5. The ditch digging and cleaning system of claim 1, wherein said at least one front blade is V-shaped.

6. The ditch digging and cleaning system of claim 1, including a pair of side blades vertically aligned on the sides of said at least one front blade.

7. The ditch digging and cleaning system of claim 1, including a beater structure for forcing dirt onto said dispersing members.

8. The ditch digging and cleaning system of claim 1, wherein said at least one front blade is comprised of a pair of front blades corresponding to said pair of dispersing members.

9. The ditch digging and cleaning system of claim 1, including at least one coulter attached to said frame in front of said at least one front blade.

10. The ditch digging and cleaning system of claim 1, including a pair of pans behind said at least one front blade, wherein an upper surface of said pan is higher than said dispersing members.

11. The ditch digging and cleaning system of claim 1, including a pair of deflector structures attached to a rear portion of said frame for directing thrown soil from said pair of dispersing members.

12. The ditch digging and cleaning system of claim 11, wherein each of said pair of deflector structures comprises:

a pair of adjustable brackets attached to said frame; and a pair of deflector members attached to said pair of adjustable brackets for guiding thrown soil from said pair of dispersing members.

13. A ditch digging and cleaning system, comprising:

a frame;

a power train attached to said frame, wherein said power train is connectable to a conventional tractor;

at least one front blade attached to said frame, wherein said at least one blade has an angle with respect to a ground surface of less than 45 degrees for severing and upwardly lifting a portion of ground; and a pair of dispersing members rotatably attached to said frame for dispersing said portion of ground elevated by said front blade, wherein each of said dispersing members have a rotational plane less than 45 degrees with respect to said ground surface.

14. The ditch digging and cleaning system of claim 13, wherein each of said pair of dispersing members comprises:

a base; and a plurality of blades attached to an upper surface of said base.

15. The ditch digging and cleaning system of claim 14, wherein said base is less than 45 degrees with respect to said ground surface.

16. The ditch digging and cleaning system of claim 14, wherein said base is a flat circular structure.

17. The ditch digging and cleaning system of claim 13, wherein said at least one front blade is V-shaped.

* * * * *